US006343383B1

(12) United States Patent
Madorma-Williams

(10) Patent No.: US 6,343,383 B1
(45) Date of Patent: Feb. 5, 2002

(54) PANTS FOR CRAWLING INFANT

(76) Inventor: Louanne Madorma-Williams, 14202 St. Clair Dr., Gainesville, VA (US) 20155

( * ) Notice: Subject to any disclaimer, the term of this patent is extended or adjusted under 35 U.S.C. 154(b) by 0 days.

(21) Appl. No.: 09/799,869

(22) Filed: Mar. 6, 2001

(51) Int. Cl.[7] ..... A41D 1/06; A41D 11/00
(52) U.S. Cl. ..... 2/227; 2/80; 2/300
(58) Field of Search ..... 2/227, 69, 75, 2/80, 111, 112, 24

(56) References Cited

U.S. PATENT DOCUMENTS 4,028,742 A * 6/1977 Marquis ..... 2/305
4,411,222 A * 10/1983 Wolfson ..... 119/96
4,449,253 A * 5/1984 Hettinger ..... 2/93
4,537,154 A * 8/1985 Kay ..... 119/96
4,599,750 A * 7/1986 Rahaman ..... 2/243 R
5,193,486 A * 3/1993 Kitchens ..... 119/96
5,369,804 A * 12/1994 Metcalf ..... 2/69
6,167,572 B1 * 1/2001 Naumovitz ..... 2/227

* cited by examiner

*Primary Examiner*—John J. Calvert
*Assistant Examiner*—Alissa L. Hoey
(74) *Attorney, Agent, or Firm*—Goldstein Law Offices, P.C.

(57) ABSTRACT

A pair of pants, for use by an infant to facilitate crawling by the infant, the pants having a front, a rear, a main portion, and a pair of leg portions extending from the main portion. The main portion has a waistband, a crotch, and a rear seam connecting the waistband and crotch. A support handle is attached longitudinally along the rear seam to allow an adult to partially support the infant's weight in order to properly position the infant for crawling. Anti-skid pads are provided on the front of the leg portions to facilitate crawling. Padding is provided within the leg portions to enhance the comfort of the infant while crawling.

5 Claims, 2 Drawing Sheets

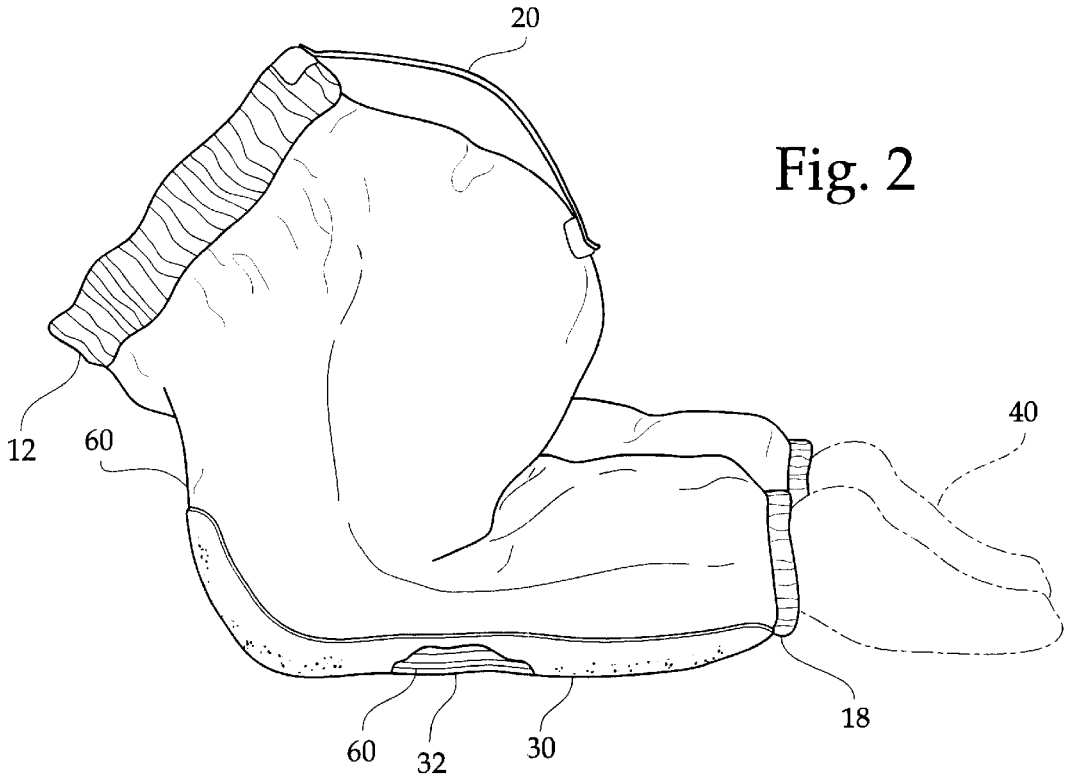
Fig. 2
Fig. 3
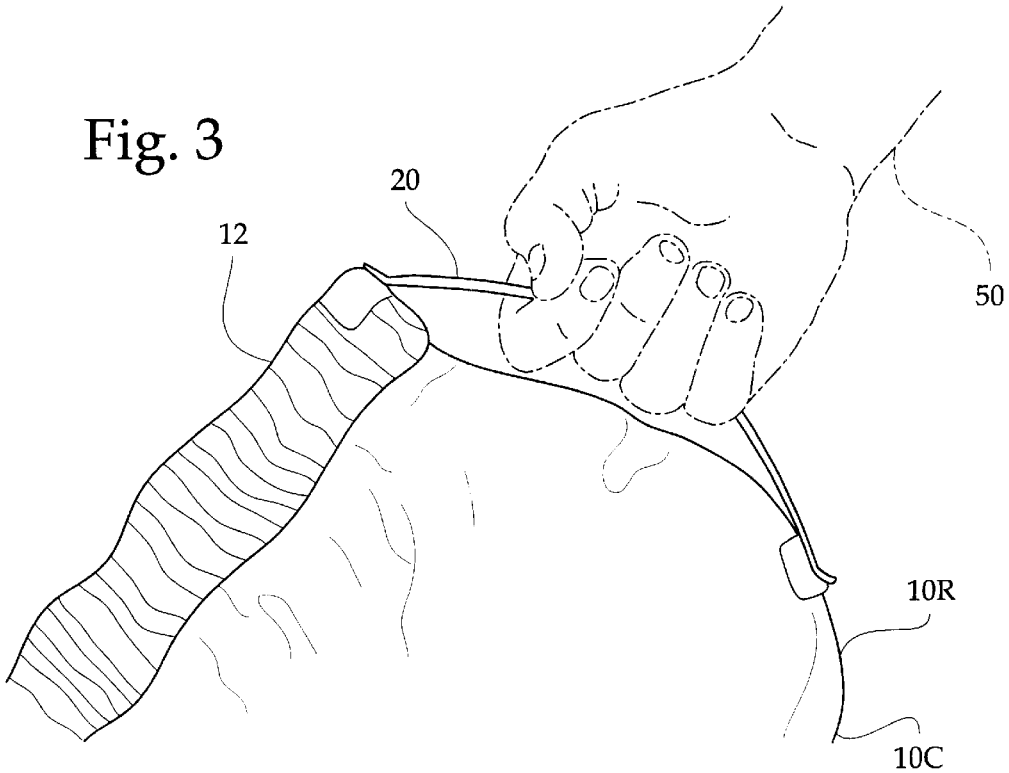

PANTS FOR CRAWLING INFANT

BACKGROUND OF THE INVENTION

The invention relates to a pair of pants for a crawling infant. More particularly, the invention relates to a pair of pants which help an infant to begin crawling while ensuring comfort and safety for the infant while crawling.

Crawling is an important step naturally taken by infants before learning to walk. However, even beginning to crawl is not easy for an infant. Crawling requires considerable arm strength that the infant does not yet possess. Even many less-than-fit adults have difficulty supporting their upper body weight with their arms. What's more, the infant cannot easily develop the needed strength before crawling. No other activities adequately prepare the infant with the necessary strength. Accordingly, it can take an infant numerous failed attempts over a considerable period of time before finally developing the arm strength needed to support his or her body.

In addition, until an infant can hold his or her body in the proper position, the legs have a tendency to slide backwards as the infant attempts to propel forward. This makes it particularly difficult for the infant to get into a proper crawling position. Such a problem is particularly acute on a smooth floor.

Further, crawling can be hard on the tender knees and shins of an infant. Tile and wood floors can quickly bruise and irritate an infant's tender skin.

Some have attempted to provide garments which seek to meet some, but not all of a newly crawling infant's needs. For example, U.S. Pat. No. 4,845,778 to Peterson discloses a garment which may include an embossed or roughened knee area to provide an anti-slip surface. U.S. Pat. No. 2,650,362 to Musgrave discloses a knee pad which attaches directly around the knees of an infant, and seeks to prevent soiling to the infant or garments thereof and to reduce irritation from frictional contact with the floor.

Others have developed garments which seek to provide protection for the adult wearer engaging in hazardous occupations, and thereby provide padded areas, and various adaptations for allowing crawling. For example, U.S. Pat. No. 4,922,551 to Anthes discloses overalls for crawling and slithering. In addition, U.S. Pat. Nos. 5,105,473 to Valtakari, 5,219,367 to Fields, and U.S. Pat. No. 5,729,832 to Grilliot et al. each disclose different garments having adaptations suitable for protecting the user in specific applications.

While these units may be suitable for the particular purpose employed, or for general use, they would not be as suitable for the purposes of the present invention as disclosed hereafter.

SUMMARY OF THE INVENTION

It is an object of the invention to produce a pair of pants which is particularly well suited for an infant that is just beginning to crawl. Accordingly, the pants have various adaptations which enhance the comfort and crawling ability of the infant.

It is another object of the invention to provide a pair of pants which make it easier for a child to begin crawling. Accordingly, the pants have a non-stick surface on the front of the pants, extending from the thighs to the shins to give the infant superior grip on the floor surface to allow more of their effort to be translated into forward motion.

It is yet another object of the invention to provide a pair of pants which make it more comfortable for the child to crawl. Accordingly, padding is provided within the garment to protect the infant's tender skin from the hardness of the underlying floor surface.

It is a still further object of the invention to provide a pair of pants which allow an adult to easily aid the child as they attempt to crawl but lack sufficient arm strength. Accordingly, a handle is provided on the posterior of the pants, which allow the adult to partially support the weight of the child. Further, the handle is suitably positioned so that with a gentle pull, the adult can easily help the child reach the proper position to begin crawling.

The invention is a pair of pants, for use by an infant to facilitate crawling by the infant, the pants having a front, a rear, a main portion, and a pair of leg portions extending from the main portion. The main portion has a waistband, a crotch, and a rear seam connecting the waistband and crotch. A support handle is attached longitudinally along the rear seam to allow an adult to partially support the infant's weight in order to properly position the infant for crawling. Anti-skid pads are provided on the front of the leg portions to facilitate crawling. Padding is provided within the leg portions to enhance the comfort of the infant while crawling.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a side elevational view of the pants, worn by a child, shown in phantom.

FIG. 3 is a side elevational view of the pants, wherein an adult, shown in phantom, is grasping the support handle and helping support the child's weight.

DETAILED DESCRIPTION OF THE PREFERRED EMBODIMENTS

Figure 1A:
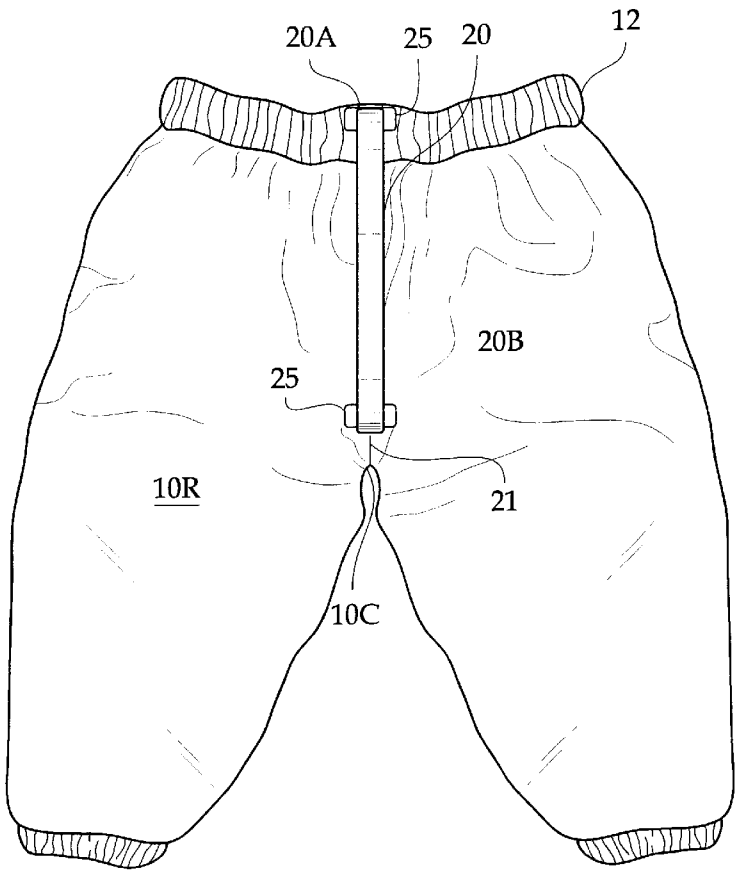
FIG. 1A is a bottom plan view of the pants, showing the support handle attached thereat.
Figure 1:
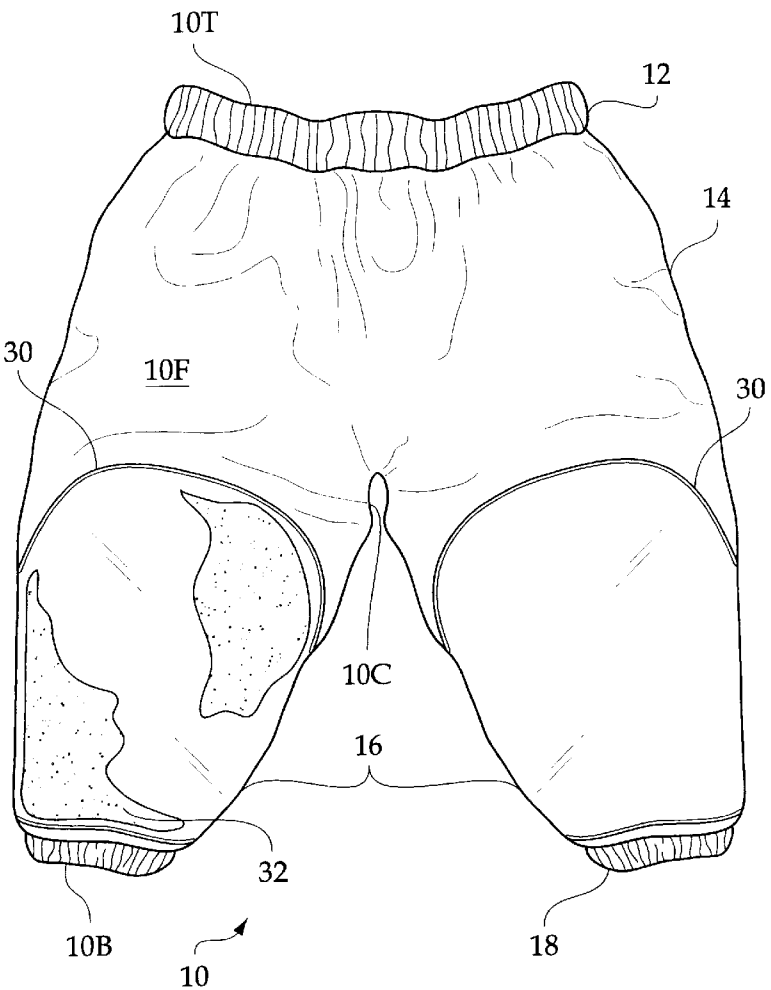
FIG. 1 is a top plan view of a pair of pants, according to the present invention, laid flat.

FIG. 1 illustrates a pair of pants 10 for use by an infant. The pants have a front 10F, shown in plan in FIG. 1, as well as a top 10T and a bottom 10B. The pants 10 further have a waistband 12 at the top 10T, a main portion 14 adjoining the waistband 12, and a pair of leg portions 16. The leg portions 16 extend substantially parallel to each other, and extend to the bottom 10B. At the bottom 10B of each of the leg portions 16 is an elastic cuff 18. The leg portions 16 meet each other and meet the main portion 14 at a crotch 10C.

FIG. 1A shows a rear 10R of the pants 10. In particular, the rear 10R has a rear seam 21 which extends from the crotch 10C to the waistband 12. In accordance with the present invention, the pants 10 have certain features which aid a child in crawling. In particular, referring to FIG. 1A, a support handle 20 is provided. The support handle 20 is attached to rear 10R of the main portion 14 longitudinally along the rear seam 21. In particular, the support handle 20 has a first end 20A and a second end 20B. The first end 20A is attached near the waistband 12, and the second end 20B is attached near the crotch 10C. As illustrated in FIG. 1A, the first end 20A and second end 20B may each be secured to the pants with lateral attachment tabs 25, which enhance the strength of attachment to the pants. In other embodiments, the second end 20B may be attached somewhat further upward along the seam toward the waistband 12, perhaps substantially midway between the waistband 12 and crotch 10C.

Referring again to FIG. 1, non-skid pads 30 are located on the front 10F, and extend from the bottom 10B up the leg portions 16 and into the main portion 14. In use, the nonskid pads 30 extend from the mid-thigh to the ankles of the wearer. The non-skid pads 30 are made of a non-slippery material, such as rubber. The non-skid pads 30 aid the child's crawling by preventing the legs from "pedaling" backwards as the child attempts to propel his or her body forward. Also seen in FIG. 1, the non-skid pads 30 are illustrated as being partially broken away to reveal padding 32 present beneath the non-skid pads 30. The padding 32 extends fully along the leg portions 16 and helps protect the child's tender legs from hard flooring surfaces.

Referring to FIG. 2, which illustrates a child 40 in phantom, wearing the pants 10, the support handle 20 is shown from the side. A space is created between the support handle 20 and the rear 10R of the pants, to allow the support handle 20 to be grasped. Accordingly, FIG. 3, shows the support handle 20 being grasped by an adult 50. The adult is pulling upward upon the support handle 20, which in turn pulls upward upon the rear of the pants 10R at the waistband 12 and near the crotch 10C. The adult 50 can thereby help support the weight of the child, to help the child enter an ideal position for crawling.

Also illustrated in FIG. 2 is the multilayered construction of the pants 10. In particular, a fabric layer 60 is made of any suitable garment material, and is used to create the overall form of the pants 10 from the waistband to the elastic cuffs 18. The non-skid pads 30 extend over the fabric layer 60 so as to directly contact the flooring. The padding 32 may extend either between the non-skid pads 30 and the fabric layer 60, or may be furthest inside of both the fabric layer 60 and the non-skid pads 30, as illustrated in FIG. 2.

In conclusion, herein is presented a pair of pants which is configured to facilitate crawling by a child. Accordingly, the front of the pants have anti-skid pads and are padded to protect the child. Further, a longitudinal support handle is provided at the rear of the pants to allow an adult to partially support the weight of the child so as to help position the child for effective crawling. These concepts are illustrated by example in the drawing figures. However, these drawings are illustrative only. Numerous variations are possible while adhering to the inventive concepts. Such variations are contemplated as being a part of the inventive concept.

What is claimed is:

1. A pair of pants for a crawling infant, having a top, a bottom, a front, and a rear, comprising:

a main portion, having a crotch, a waistband, and a rear seam extending between the crotch and waistband on the rear of the pants;

a pair of leg portions adjoining the main portion, the leg portions extending between the main portion and the bottom of the pants;

a support handle, attached to the rear of the main portion, the handle extending longitudinally along the rear seam, for allowing an adult to partially support the weight of the infant wearing the pants when teaching the infant to crawl.

2. The pair of pants, as recited in claim 1, wherein the support handle has a first end and a second end, the first end is attached to the rear of the main portion near the waistband and the second end is attached to the rear of the main portion near the crotch.

3. The pants as recited in claim 2, further comprising a pair of anti-skid pads, each of the anti-skid pads extending from the bottom of one of the leg portions up into the main portion immediately above said leg portion, the anti-skid pads preventing the infant from sliding while attempting to crawl.

4. The pants as recited in claim 3, further comprising padding, located within the leg portions and extending fully along said leg portions, for softening impact against the legs of the infant as the infant crawls.

5. An infant crawling method, employed by an adult with an infant to facilitate crawling by the infant, comprising the steps of:

providing a pair of pants having a front, a rear, a main portion, and leg portions, a support handle attached longitudinally on the rear of the main portion, and anti-skid pads located along the front of the leg portions;

wearing the pants by the infant;

positioning the infant on a ground surface;

lifting the support handle by the adult; and allowing the infant to crawl while partially supporting the child by the adult with the support handle.

* * * * *